US005947406A

United States Patent [19]

Burlingame

[11] Patent Number: 5,947,406

[45] Date of Patent: Sep. 7, 1999

[54] FIBER GUIDE

[75] Inventor: Roger Francis Burlingame, Thousand Oaks, Calif.

[73] Assignee: Litton Systems Inc., Woodland Hills, Calif.

[21] Appl. No.: 08/918,734

[22] Filed: Aug. 1, 1997

[51] Int. Cl.[6] ..... B65H 57/00; B65H 57/04; B65H 54/28

[52] U.S. Cl. ..... 242/478.2; 242/157 R; 242/157.1; 242/615.3; 242/920

[58] Field of Search ..... 242/615.3, 157 R, 242/157.1, 478.2, 483.3, 920, 158 R, 447.1, 447.2, 447, 548.3, 25 R

[56] References Cited

U.S. PATENT DOCUMENTS

| | | | |
|---|---|---|---|
| 1,587,998 | 6/1926 | Adams | 242/158 R |
| 2,906,468 | 9/1959 | Wellcome | 242/25 R |
| 3,814,348 | 6/1974 | Johnson | 242/478.2 |
| 4,150,801 | 4/1979 | Ikegami et al. | 242/158 R |
| 4,202,512 | 5/1980 | Nicholson, Jr. | 242/157.1 |
| 4,428,540 | 1/1984 | Calcagno et al. | 242/478.2 |
| 4,856,900 | 8/1989 | Ivancevic . | |
| 4,884,764 | 12/1989 | Hill | 242/158 R |
| 5,371,593 | 12/1994 | Cordova et al. . | |
| 5,405,485 | 4/1995 | Henderson et al. . | |
| 5,564,637 | 10/1996 | Berthold et al. | 242/25 R |

*Primary Examiner*—Michael Mansen
*Attorney, Agent, or Firm*—James F. Kirk

[57] ABSTRACT

A fiber guide for spooling glass fiber from an automatic coil winding machine onto a spool. The guide has a pay guide assembly with a receiving aperture. Two similar sections are held together with a slight gap between them. Left and right parallel strands of music wire are tightly stretched through the gap across the receiving aperture of the arc and are anchored at each end. A spool receives the left and right parallel strands or guides and is maintained very close to the last layer or surface of fiber laid down. A guide pulley is carried by the guide for guiding glass fiber between the left and right parallel strands and onto the spool. The parallel strands are tensioned by anchoring each wire in a respective standoff. In one embodiment, each end of a music wire wraps around a standoff. The wires extend through the cross drilled holes permitting adjustment by turning the standoff. In an alternative embodiment, a tensioner is formed by a pivotal plate, relative to the guide. The pivotal plate tightens the left and right parallel strands by spring force generated by a spring connected between the pivot plate and the guide. In another embodiment, the left and right parallel strands are spaced apart by washers having a predetermined thickness.

14 Claims, 9 Drawing Sheets

FIBER GUIDE

FIELD Of INVENTION

The present invention is a fiber guide for use on an automatic coil winding machine in the manufacture of fiber optic coils useful in fiber optic gyros. The invention accurately guides and positions the optical glass fiber as it is coiled onto a spool such as a fiber optic coil for use in a fiber optic gyro or rate sensor.

RELATED ART

A fiber guide, called a pizza cutter, is the closest related art known. While winding a fiber coil, the fiber must be guided to make contact with the side walls (flanges) of a spool or coil form or bobbin comprising a spindle on which the coil is wound and in most cases at least one flange. The fiber guide, used to control the point of deposit of the fiber onto the surface of the coil, must be made as thin as practical so it can lay fiber close to the flanges. Minimum size of the fiber guide is determined by the radius of the spindle upon which the fiber is being wound plus the flange extending beyond the spindle.

Stated another way, the fiber guide radius plus the spindle radius must exceed the spindle flange radius. The rotational axis of the fiber guide must be located outside of the flange circumference. Larger diameter fiber optic coils will require large spool diameters and even larger associated guide wheel diameters. As the diameter of a pizza cutter wheel type guide is allowed to increase, the diameter of the guide wheel and the continuing requirement for the thickness of the wheel to be thin, so as to be able to approach the flanges, combine to cause the wheel to deflect or deform slightly resulting in a loss of precision in the deposition of the fiber forming the coil.

It is difficult to fabricate a wheel of large diameter because as the diameter is increased, maintaining the wheels flatness under load becomes very difficult. As flatness is lost, the wheel will start to wobble and interfere with the precise deposition of optical fiber onto the top layer of fiber on the coil being fabricated.

The present invention is not limited by the diameter of the side walls or the flanges and is capable of being used to manufacture large diameter fiber optic coils. In addition, the present invention is more robust in comparison to the prior art. It can tolerate impacts against the spool flange without damage due to compliance of the wire strands where the prior art would deform or become dented or out-of-flat.

Additionally, the fiber often tends to □pop-out□ of the pizza cutter style prior art guide wheel during use. This condition is eliminated with the present invention.

SUMMARY OF THE INVENTION

The invention comprises a fiber guide for spooling fiber optic or glass fiber from an automatic coil winding machine onto a target rotating spool. This invention fiber guide may find employment in other applications in which other forms of fiber, filament or wire, such as magnet wire, must be accurately guided onto a rotating flanged spool.

A first embodiment of the invention fiber guide comprises in combination; a rigid body. The rigid body, more particularly referred to as a payguide assembly, is comprised of two parts with a gap between the parts. The parts are referred to as a left and right payguide hand coupled together in opposing relation to form a mouth or receiving aperture shaped as an arc. Two parallel strands of wire are tightly stretched across the mouth of the arc and anchored. They are spaced apart along the length of the body or opening of the mouth or receiving aperture. The parallel wire strands or guide wires are in the alternative, formed from piano or music wire. A spool or bobbin or fiber optic coil that receives the fiber is mounted or positioned so that it extends into the arc or aperture formed by the payguide assembly. The guide wires or wire strands are positioned very close to the surface of the surface layer of fiber being wound.

A guide pulley is carried or mounted in the body. The pulley operates to guide the fiber between the wire strands and onto a spool or fiber optic coil that is being fabricated for use in a fiber optic gyro or a hydrophone for use as an interferometer sensor in an acoustic application such as a towed array or a planar array.

The guide pulley is rotatably mounted on a guide pulley shaft. The guide pulley shaft is carried by the body or payguide assembly. The guide pulley rotates on the shaft to guide the fiber from the winding machine onto the spool via the space between said wire strands. A guide pulley bearing means is positioned on the shaft for rotatably supporting the guide pulley.

The predetermined position of the bearing means is a manually adjusted position to preload the bearing means to be substantially free of wobble.

The gap or throat spacing is established by machined surfaces on the abutting or contiguous surfaces of the right and left payguide hands to the rear of the throat so as to leave the throat unobstructed. The gap at the top and bottom of the payguide assembly forms a top and bottom throat to allow the insertion of fiber. The space in the throat must be sufficiently unobstructed as to allow the passage of a fiber. With an open throat, it is possible to pass the central portion of a fiber that is stored on two feed bobbins so that a winding machine can wind the fiber onto the fiber coil in alternate layers starting from the mid point of the length of continuous fiber. Quadrapole winding with optical fiber is done in this manner.

In each embodiment, a means for anchoring the wire strands to the payguide assembly, and a wire tensioning means carried by the payguide assembly to tension the wire strands.

Each respective throat has a respective first and second side separated by a predetermined distance. Each respective wire strand passes over the edge of the end of a payguide arm into the throat, the wire strand being there in contact with a corresponding top and bottom side.

The payguide hand has a hole to receive a threaded end of a hollow threaded standoff. The standoff has a cross hole through the body orthogonal to the axis of the body. A wire strand is passed through the hole and a rubber plug followed by a set screw is inserted into the hollow end of the standoff and screwed into the hole until the rubber plug engages the wire strand passing through the cross hole preventing further movement of the wire. The wire strands are subjected to a predetermined preload to place them in tension before the set screw is tightened. The preloading step in combination with a standoff or other anchoring means combine to form a tensioning means.

In an alternative embodiment of the tensioning means a box or pair of pivot plates forming a box is pivotally connected to the payguide assembly and to the wire strand or guide wires. A spring is connected between the plate and the payguide assembly for drawing the wire into a tensioned condition. A threaded screw adjustably holds the spring to the box or plates forming a box. The threaded screw engages the box at a distance from the pivotal connection between the box and the payguide assembly so as to apply a torque to the box as the distance between the box and the spring is shortened by operation of the threaded screw.

In each embodiment, the fiber guide is comprising a pivotal connection from an automatic coil winding machine and the body or payguide assembly. A payguide arm serves as a means for connecting the pivotal means on the winding machine and said body.

In each of the embodiments of the fiber guide, the spool or fiber optic coil onto which optical fiber is being wound, has a spool rotation axis and a predetermined window, similar in its characterization to the winding window formed by the bobbins or coil forms used by magnetic component production, for receiving fiber. The window is formed by the flanges at the ends of a coil form or spindle. The spindle has a surface that is typically cylindrical. A left and right flange each have an inner surface of predetermined height that extend above the spindle surface.

In each embodiment, the coil winding machine further comprises a servo means (not shown) for moving the fiber guide parallel to the spool rotation axis as the spool or coil form is rotated. A guide pulley guides the fiber between the wire strands or wire guides onto an outer surface of a fiber coil being formed on the spool.

In another embodiment of the fiber guide, the wire strands are electrically insulated from the automatic coil winding machine. In addition, the automatic winding machine provides a means for electrically sensing and teaching the servo means where the limits of linear travel exist for the wire strands parallel to the rotation axis of said spool rotation axis. The limits exist where the outer surface of wire strands electrically contacts a corresponding left or right flange inner surface.

A teaching tool is shown for transferring the location and position between spaced apart pair of non-conductive inner flange surfaces to an external space bordered by conductive surfaces for teaching the linear servo where the limits of travel should be set.

DETAILED DESCRIPTION OF THE PREFERRED EMBODIMENT

Figure 1:
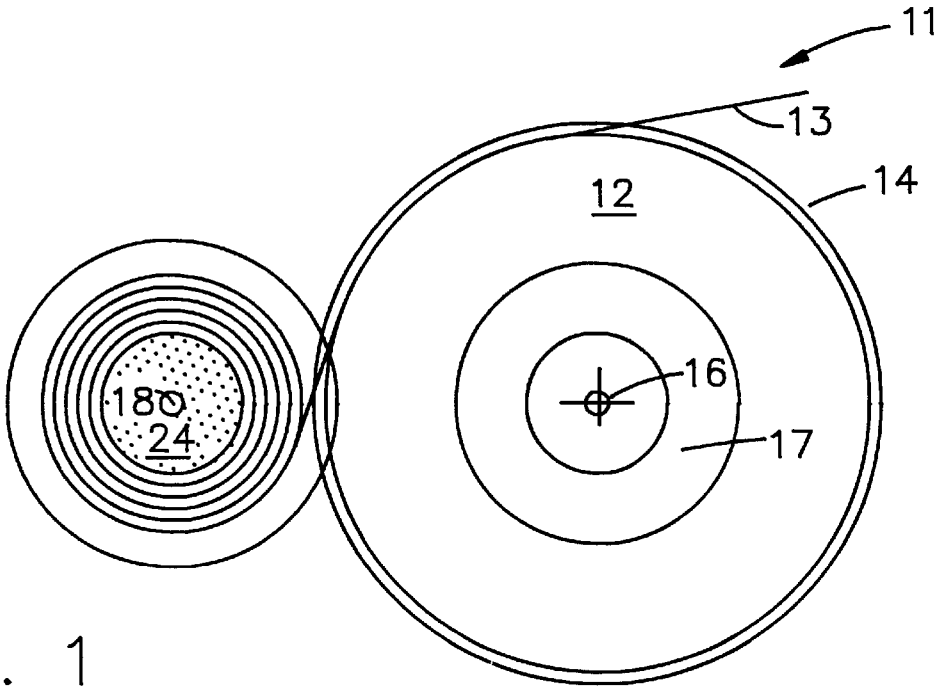
FIG. 1 PRIOR ART
FIGS. 1 and 2 are side elevational and top plan views of prior art pizza cutter type fiber guides.
Figure 2:
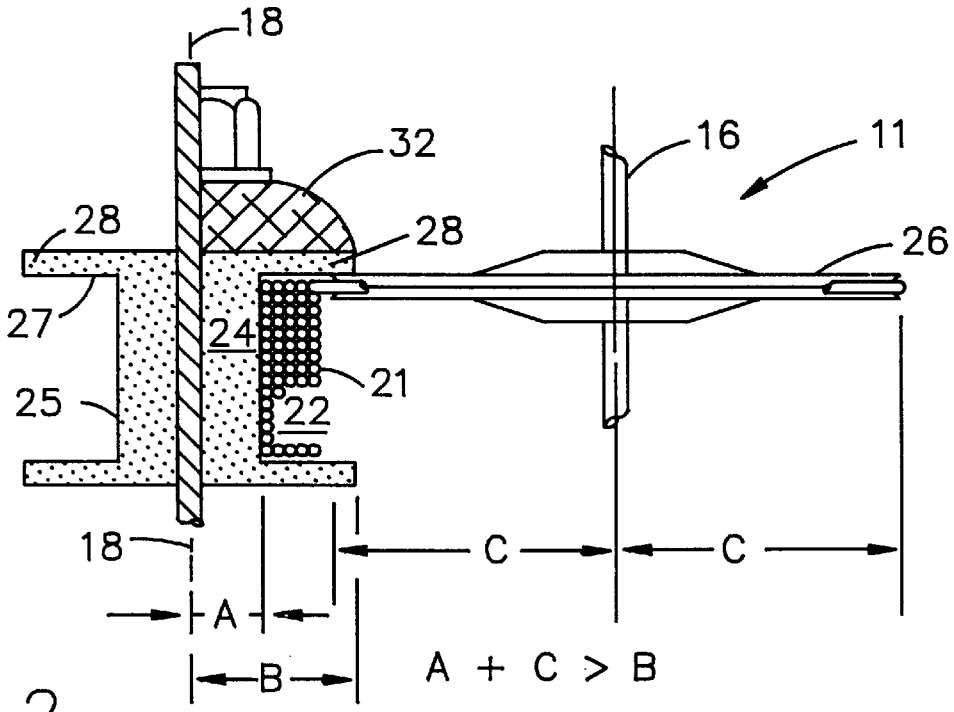
FIG. 2 PRIOR ART

FIGS. 1 and 2 show an earlier pizza cutter style fiber guide 11 with its guide wheel 12 portrayed as thin as possible. Optical fiber 13 is carried in the grooved circumferential outer edge 14 of the guide wheel 12. The guide wheel 12 rotates on its guide wheel shaft 16.

In operation, the guide wheel 12 is mounted on a coil winding machine (not shown) and is translated by a linear servo motor drive (not shown) parallel to the rotational axis 18 of spool or coil form 20. The guide wheel 12 feeds fiber onto the rotating outer layer or outer surface 21 of the fiber coil 22 that is being formed on the rotating spindle 24 of the spool or coil form 20. The space on a plane passing through the axis of the coil form or bobbin 20 and bordered by the spindle surface 25 of the spindle 24 and the inner walls 27 of spool flange 28 forms a winding window.

FIG. 2 schematically shows the fiber guide 11 driven by linear servo motor drive (not shown) moved to the right or upward in the figure until the top surface 26 of the guide wheel 12 deposits the last fiber coil on the outer or top layer 21 of the fiber coil 22 and contacts the right spool flange 28 inner surface 27. As shown in FIG. 1, fiber guide 11 is translated in and out of the page, as the spool 20 rotates on its axis 18.

As shown in FIGS. 1 and 2, the minimum size of the guide wheel radius C is determined by radii A (of the spindle 24) and flange radius B, of the spool or coil form 20. The guide wheel shaft 16 must always be located outside the spool's flange radius "B". From FIG. 2, it can be seen that the sum of the guide wheel radius C and the spindle radius A must be greater than the radius of the spool flange B or (C+A>B).

Figure 3:
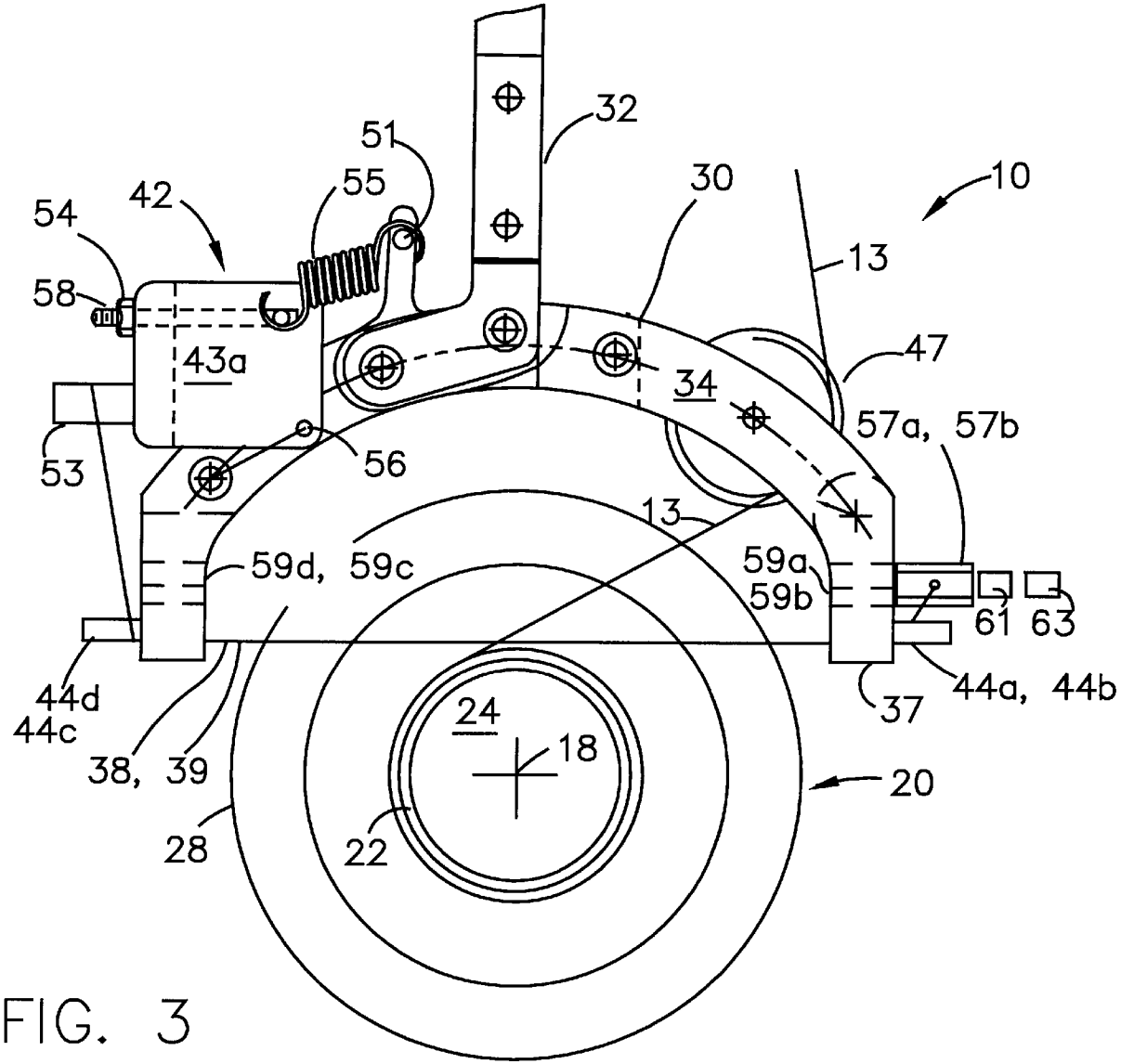
FIG. 3 is an elevational view of the present invention fiber guide.
Figure 4:
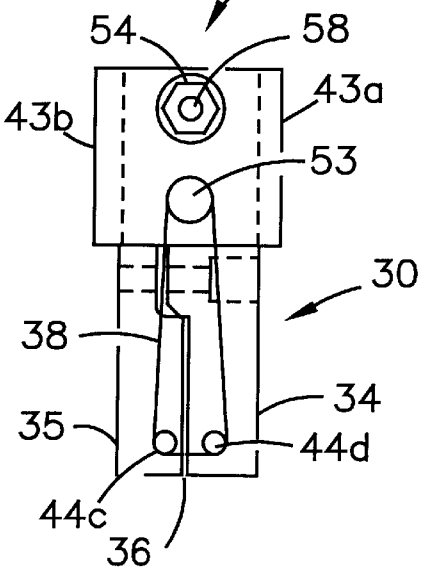
FIG. 4 is an end view of FIG. 3 showing a toggle plate tensioner.

FIGS. 3 and 4 show a first embodiment of the present invention fiber guide 10 comprising a rigid body comprising a pay guide assembly 30 and pivot arm 32. The pay guide assembly 30 forms an arcuate body having an arcuate opening, the body comprising two parts or similar sections, i.e. a left and right pay guide hand 34, 35 with a gap between the parts. A bottom throat 36 is shown in FIG. 4. The location of a top throat 37 is shown at the right in FIG. 3. Each throat has a respective first and second side separated by a predetermined distance.

In the first embodiment of FIGS. 3 and 4, two parallel wire strands of music wire, a left and right parallel strand or guide 38, 39 are tightly stretched across the arcuate opening or cord of pay guide assembly 30 and are anchored at one end (the right end). The parallel strands or guides extend from pin 53 on tensioner 42 at the other end (the left end).

A length of music wire is first draped over the large dowel pin 53 and then wrapped around dowel pins 44*d*, 44*c* to pass through the bottom throat 36 at the left of the pay guide assembly 30. The wires then pass across the arcuate opening or cord to and through the top throat 37 at the right of pay guide assembly 30.

Each pay guide hand 34, 35 has an upper and lower end. Each upper and lower end has a respective registration face. Opposing registration faces form a respective top or bottom throat 36, 37. The pay guide hands are held together and dimensioned to create the slight gap e.g. 0.016 inches between opposing pairs of upper and lower registration faces 36, 37. Each respective wire strand is therefore in contact with a corresponding pay guide hand upper and lower registration face.

A pair of aluminum dowel pins 44*a*, 44*b* and a pair of hexagonal standoffs 57*a*, 57*b*, the second in each pair being hidden by the first, are similarly disposed at the right end of the pay guide arm. The standoffs serve to anchor the respective wire strands as tension is adjusted by rotating the hexagonal hollow standoff bodies 46*a*, 46*b* of the standoffs 57*a*, 57*b* or by other preferable alternative means.

The pay guide assembly 30 has an open mouth to receive spool or coil form flange 28. Glass or fiber optical fiber 13 bends around a 1 inch guide pulley 47 carried by the arcuate body or pay guide assembly 30 for guiding the fiber between parallel spaced apart wire strands or wire guides 38, 39 onto the spool 20 which guide it very closely to the last layer of fiber laid down on fiber optic coil 22. The parallel wire strands or guides 38, 39 are formed from piano or music wire or other filament having high tensile strength such as glass fiber or steel wire.

The guide pulley 47 is carried by the body for guiding the fiber between the wire strands 38, 39 and onto the spool 20 or more particularly onto the rotating outer surface 21 of the fiber coil 22.

Spool 20 is turned on axis 18 (FIG. 3) to draw the fiber 13 onto the fiber coil 22. Pivot arm 32 may be pivoted to maintain the proximity of optical fiber 13, wire strands 38, 39 and the rotating outer surface 21 of fiber coil 22 on spool 20 receiving optical fiber 13.

Figure 13:
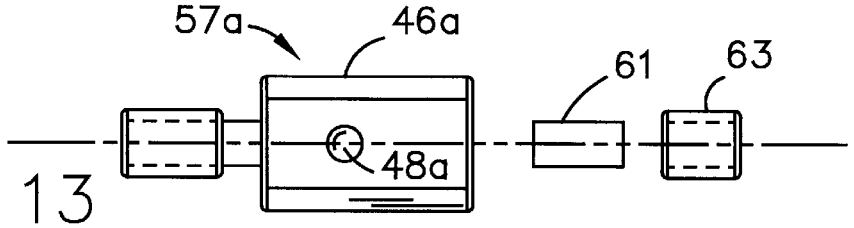
FIG. 13 is an exploded side elevation of the drilled standoff, the o-ring or rubber plug insert and the set screw.

FIG. 13 shows a disassembled hexagonal standoff 57*a* having a threaded hexagonal hollow standoff body 46*a*, a transverse receiving hole 48*a* drilled therein to receive ends of the left and right parallel strands or guides 38, 39 and in combination with rubber plug 61 and screw 63 form a means for anchoring the left and right parallel strands to the pay guide assembly or pay guide arms 34, 35.

The combination of the pay guide hands and the anchor provided by the large pin 53 along with the dowel pins 44 at each end and the standoffs 57 form a wire tensioning means. The continuous wire strand is draped over the large pin and then routed through each of the two throats. In the process, several turns of the wire is wrapped around the dowel pins 44 and then around and through the standoffs at the opposing end of the payguide hands form the wire tensioning means. The initial tension in the wires is adjusted via rotating the standoffs. Final adjustment is made by adjusting the nut on screw 58 shown in FIG. 3.

Referring to FIG. 4, wire tensioner 42 pivots in a clockwise direction around pivot pin 56 in response to tension in spring 55 to maintain tension in wire strands 38, 39 by pulling the pivotal plate or block 43 to raise the large pin 53 thus tensioning the wire strand around dowel pin 44.

Spring 55 is fixed to pay guide assembly 30 by pin 51 and extends between parallel plates 43*a*, 43*b* of tensioner 42 to engage tension adjusting screw 58 to force the plates 43*a*, 43*b* to the right, thereby maintaining the left and right parallel strands or guides 38, 39 taut. Tension is adjusted as required by rotating a nut 54 shown on the left end of adjusting screw 58.

FIG. 3 shows that the other ends of the strands are each anchored pay guidepay guide assembly 30 by standoffs 57*a* and 57*b*. In FIG. 3, standoff 57*b* is hidden behind standoff 57*a*. Each standoff is screwed into a corresponding cross-drilled hole at 59*a*, 59*b* with the wire strands penetrating the standoffs 57*a*, 57*b* and being wrapped around the respective dowel pin 44*a*, 44*b*. Cross-drilled hole 59*b* and dowel pin 44*b* are also hidden behind their respective 59*a*, 44*a* counterparts. The left and right parallel strand or guides 38, 39 are wrapped around a respective dowel pin 44*a*, 44*b* and then penetrate the respective hexagonal hollow standoff bodies 46*a*, 46*b*. Cross drilled holes 59*d* and 59*c* are not used but are available for use by standoffs as an alternative to tensioner 42.

Figure 9:
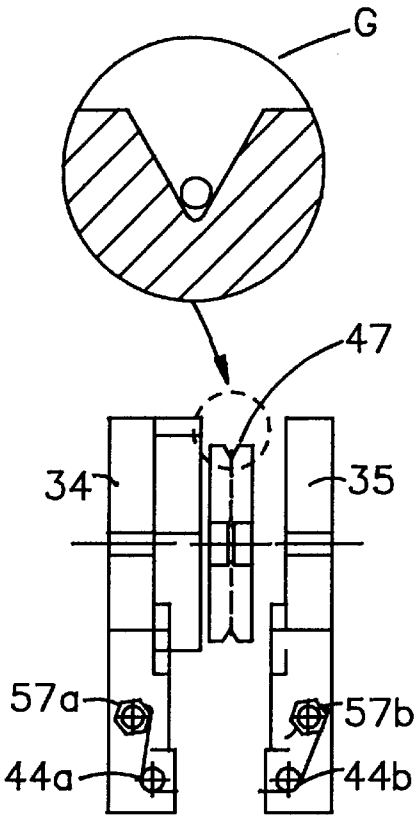
FIG. 9 is an exploded top elevation view of the left and right pay guide arms and the guide wheel.
Figure 8:
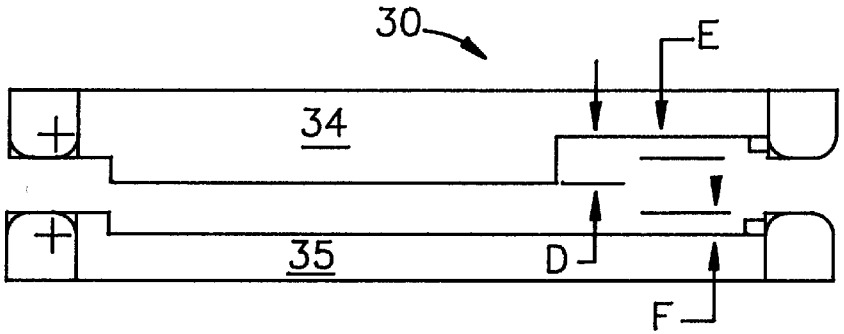
FIG. 8 shows a top elevation view of the left and right pay guide arms, the guide wheel being omitted.
Figure 10:
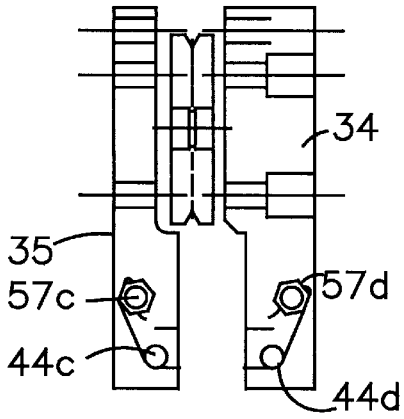
FIG. 10 is an exploded bottom elevation view of the left and right pay guide arms and the guide wheel.

FIGS. 8–10 show an alternative embodiment in which each end of the left and right pay guide arms 34, 35 is drilled to provide a corresponding cross-drilled hole which is then threaded to receive the external threaded end of a standoff (not shown). Two standoffs 57*a*, 57*b* are used in the embodiment of FIG. 3 which uses a tensioner 42. Four standoffs are used in the embodiment of FIGS. 8–10 in which the tensioner 42 is omitted. The standoffs are hex #6-32 internally threaded to receive rubber plug 61 and #6-32 set screw 63. The wire strands are first placed over large pin 53, and around dowel pins 44 and brought to the other end of body 30 and anchored.

Figure 5:
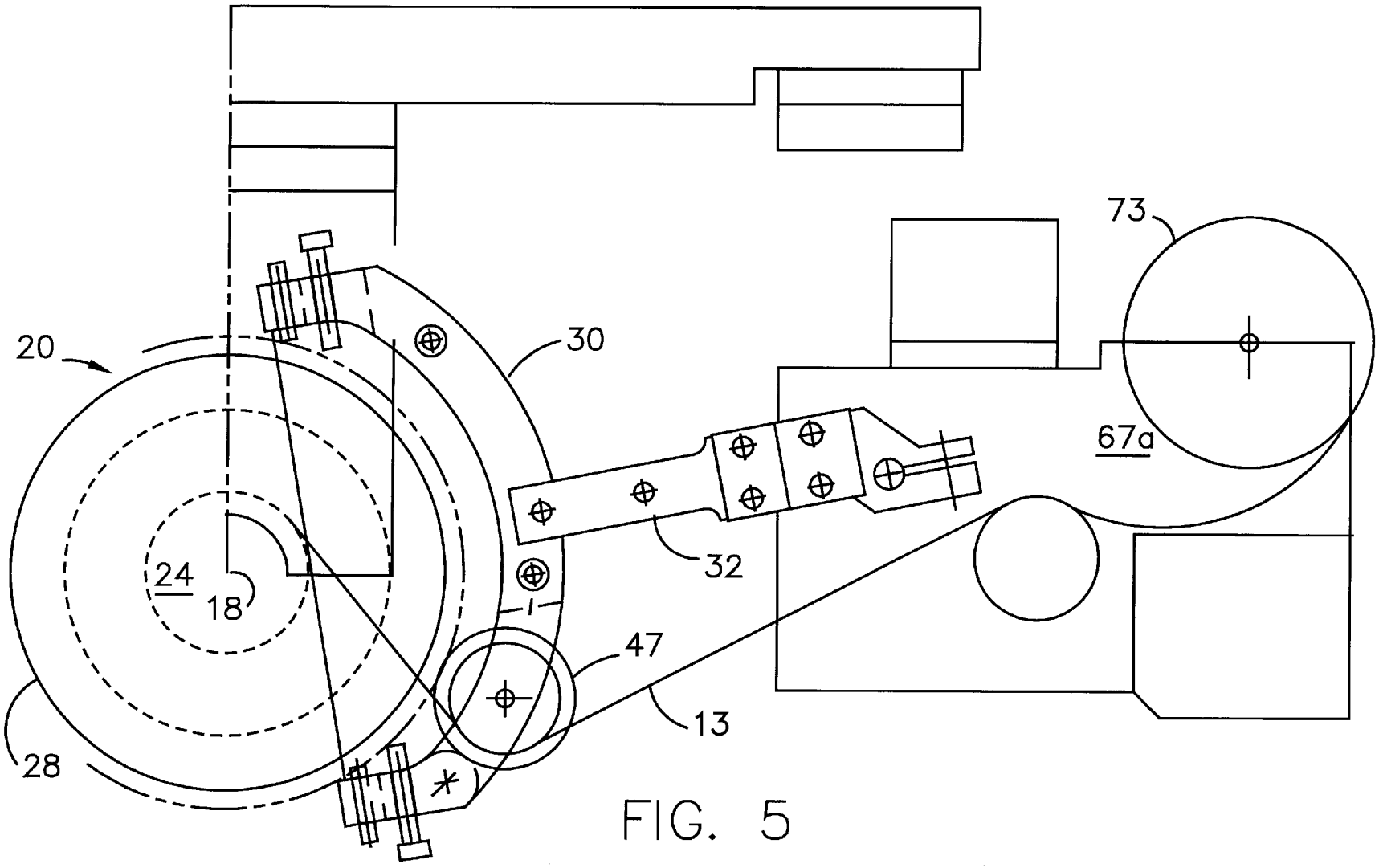
FIG. 5 shows the new fiber guide pivotally mounted from an automatic winding machine.

FIG. 5 shows the payguide assembly 30 mounted offset from the automatic machine 67*a* by pivot arm 32. The preferred layout of the pivot arm 32 is 10 degrees below the horizon, (in the figure) the ends of the payguide assembly 30 are on a phantom circle having a diameter of 3.93 inches (just slightly larger than the O.D. of the spool flange 25). Optical fiber 13 is shown leaving a fiber source spool or half transfer spool, passing under the guide pulley 47 and between the wire strands 38, 39. The wire strands are depicted as almost touching the outer layer 21 of coil 22.

Figure 6:
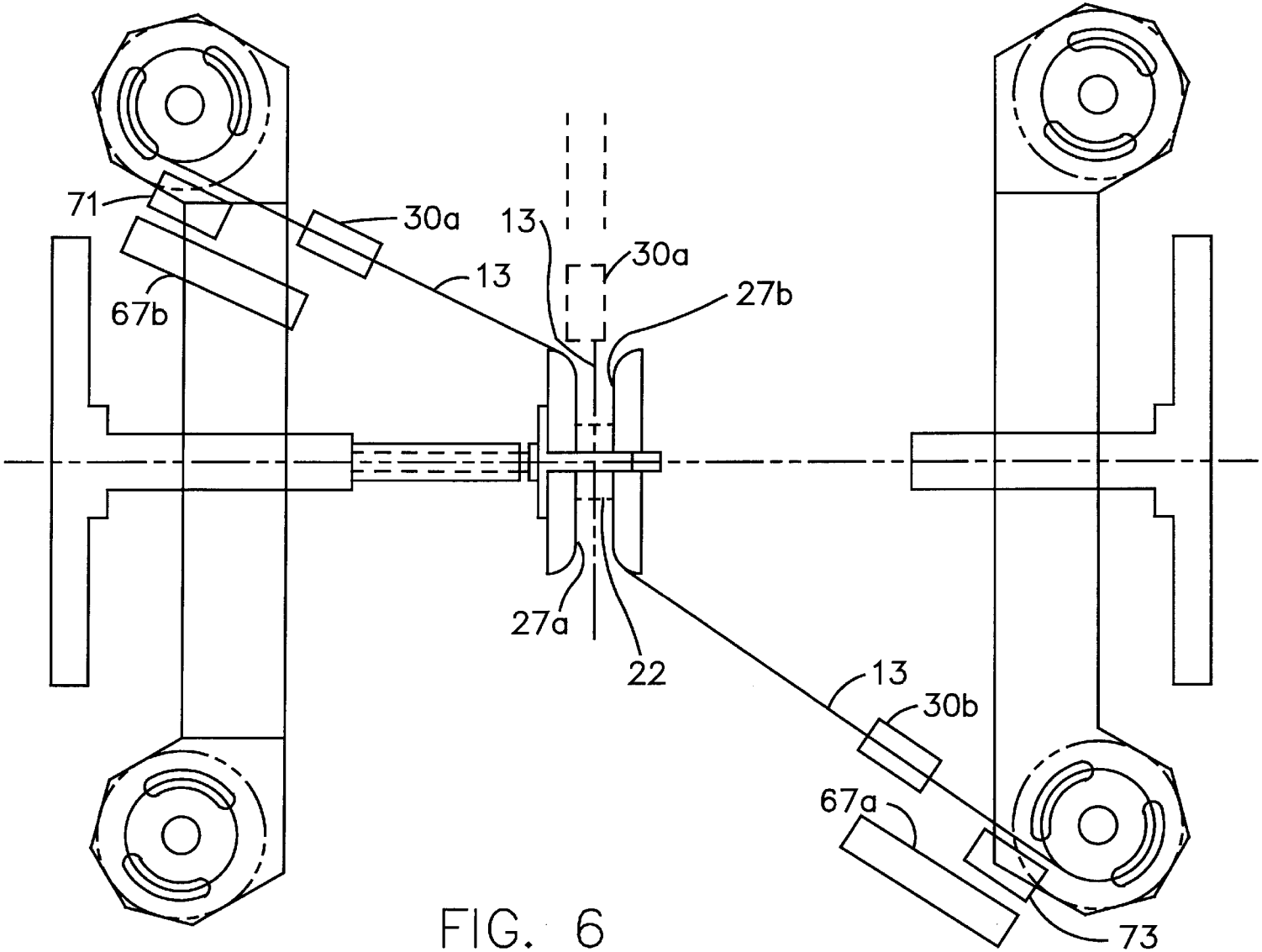
FIG. 6 illustrates quadrupole winding employing the subject new fiber guide.

In FIG. 6, is a schematic layout to show how quadupole winding is accomplished by the present invention with two fiber guides each being sourced with fiber from a respective half transfer spool 73. The fiber guide 30*b* at the lower right is in its stored position. The fiber guide 30*a* at the upper left is also in a stored position; however, the same guide 30*a* is depicted in phantom in its registered position above the coil form. The use of two fiber guides permits alternated ends of the fiber to be controlled and fed in alternated layers between the spool flanges 27*a*, 27*b*.

U.S. Pat. Nos. 4,856,900 to Ivancevic, 5,371,593 to Cordova et al and 5,405,485 to Henderson, all incorporated herein by reference in their entirety, explain the details of quadrupole winding and how an automatic winding machine is made and operates to make coils for fiber optic rotation sensors.

FIG. 6 shows the automatic machines 67*a* and 67*b* represented as blocks and the two half transfer spool sources of fiber 71 & 73 used to alternately lay down layers of fiber between the spool flanges 27*a*, 27*b* on fiber coil 22.

Figure 7:
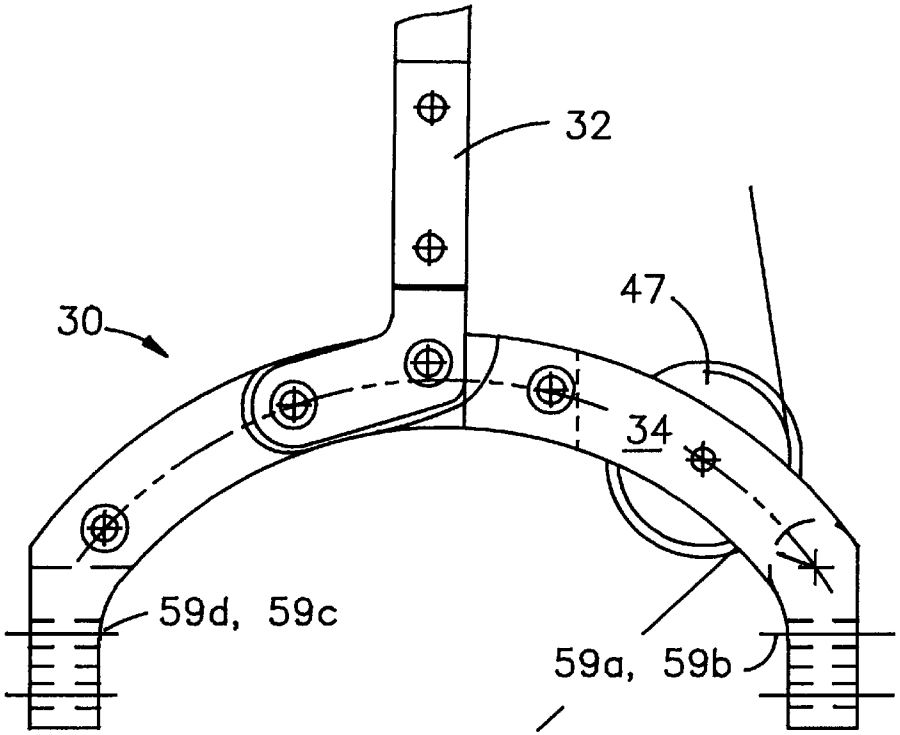
FIG. 7 shows the pay guide assembly with guide wheel guiding optical fiber.

FIG. 7 is a schematic plan view showing the pay guide assembly 30 with pivot arm 32 attached. The guide pulley 47 is supported by a shaft and bearing means and is depicted as guiding optical fiber 13. A pivotal connection (not shown) from the winding machine holds the pay guide assembly in proper position and orients the pay guide. As shown in FIG. 5, a declination angle of 10 degrees from level leading to the coil spindle has been found to be best for operation.

FIG. 8 is an exploded forward view of the pay guide arm showing a left and right pay guide hands 34, 35 that comprise the pay guide. As the hands are joined, in the central region, it can be seen that a hole or recess for receiving the guide pulley 47 is provided. The throat gap for the left and right throat can be seen to be approximately equal to dimension G where G=D−(E+F)

FIG. 9 is an exploded plan view of the top view of the left and right pay guide hands and the guide pulley 47. The insert phantom circle figure is a schematic depicting the optical fiber 13 residing in a circumferential groove in the guide pulley 47. Left and right dowel pins 44 and left and right standoffs are also shown with the wire strands wound thereon and passing down into the top throat.

FIG. 10 is an exploded plan view of the bottom view of the left and right pay guide hands and the guide pulley which would be obscured if the left and right hands are brought together. Use of the standoffs shown will depend on the tensioning means selected.

Figure 11:
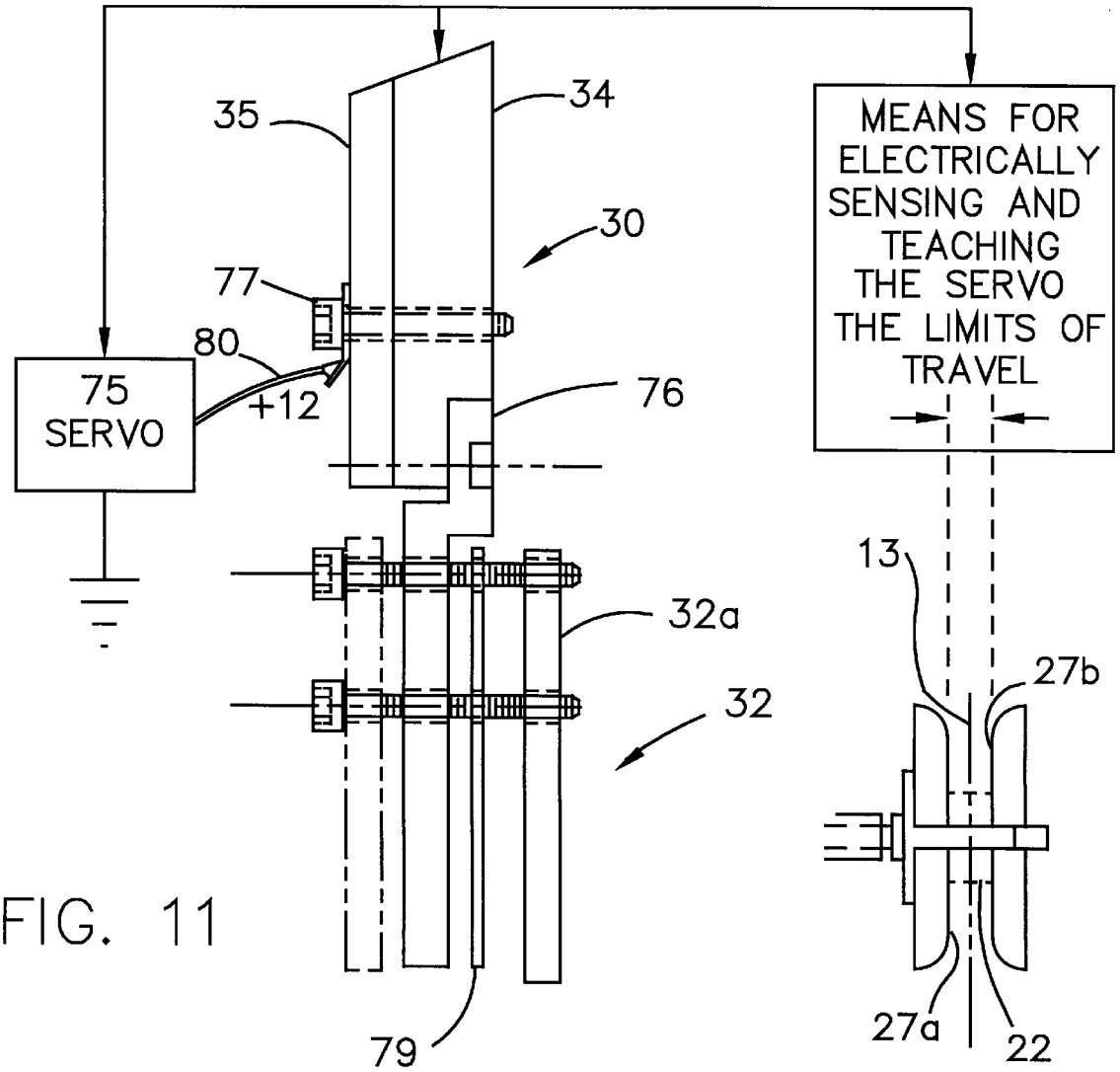
FIG. 11 is an exploded top plan view showing the pay guide assembly attached to the guide arm, the guide arm being insulated from the pay guide assembly by a kapton insulator.

FIG. 11 is a top plan view of the pay guide 30 with the left and right pay guide hands 34, 35 clamped together by a contact bolt 77. The contact bolt also electrically connects a signal source via a terminal to the right pay guide hand 35.

The pivot arm 32 is shown as an exploded assembly comprising a pivot arm adaptor 76 coupled to the left pay guide arm 34 and a pivot arm extension 32*a* coupled to the pivot arm adapter 76 and to the winding machine (not shown). An insulator, such as a kapton insulator 79 is interposed between the pivot arm extension 32*a* and the pivot arm adaptor 76 for insulating the pay guide assembly 30 from the pivot arm extension 32*a*. Non-conductive screws couple the pivot arm adapter to the pivot arm extension 32*a*. A phantom pivot arm extension is shown at the left of the pivot arm.

In this arrangement, wire strands 38, 39 (not shown) are electrically insulated from the automatic coil winding machine. The position of the pivot arm extension relative to the adapter would be switched to the phantom position for use in the second fiber guide on an automatic winding machine.

Figure 15:
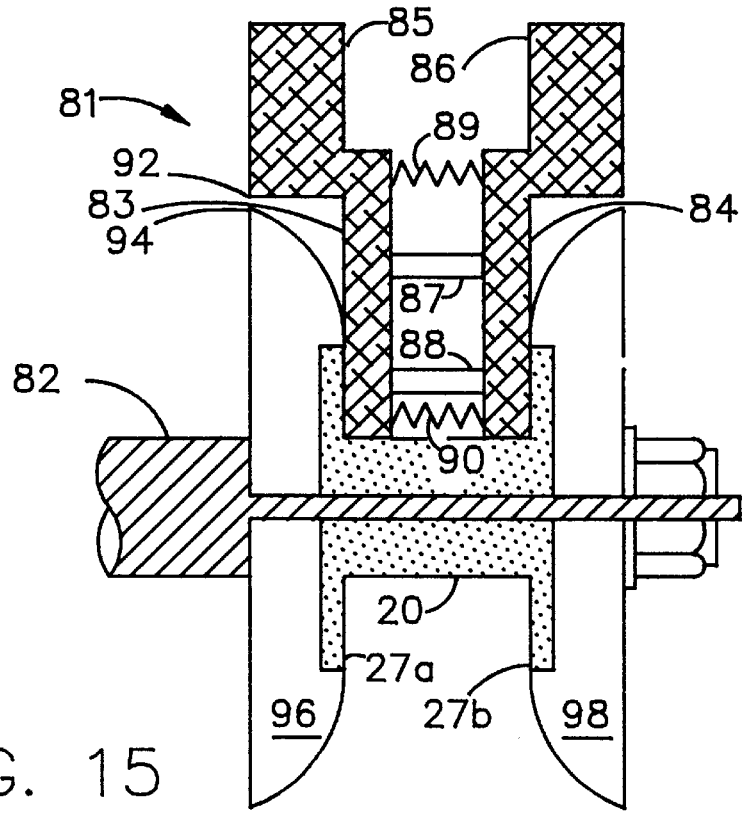
FIG. 15 is a schematic sectional view of a tool used to provide a conductive surface that is co-planar with a spool's non-conductive left and right inner flange surfaces.

The use of the kapton insulator and an electrical signal source represents a means for electrically sensing and teaching the servo means (not shown) the limits of travel parallel to the rotation axis of the spool rotation axis 18 necessary to bring each respective strand to a corresponding left and right spool flange inner surfaces 27*a*, 27*b* as shown in FIG. 6 and FIG. 15.

When a bobbin is used having conductive flanges, the contact of the electrically excited music wire with the flange produces an electrical response that is detected by a sensor that signals the location of the linear motor servo into a memory for storage. The electrical contact surface on the inner wall of the bobbin is in fixed relation with the winding machine frame.

The detected signal is used to signal the lateral drive servo and computer control moving the fiber guide to stop or reverse its direction each time the guide reaches the end of a layer of fiber coils. The encoder readout for the position of the guide at the point of electrical contact is stored and thenceforth used as the learned drive limit for lateral movement of the fiber guide carried by the servo drive assembly on the winding machine.

Figure 12:
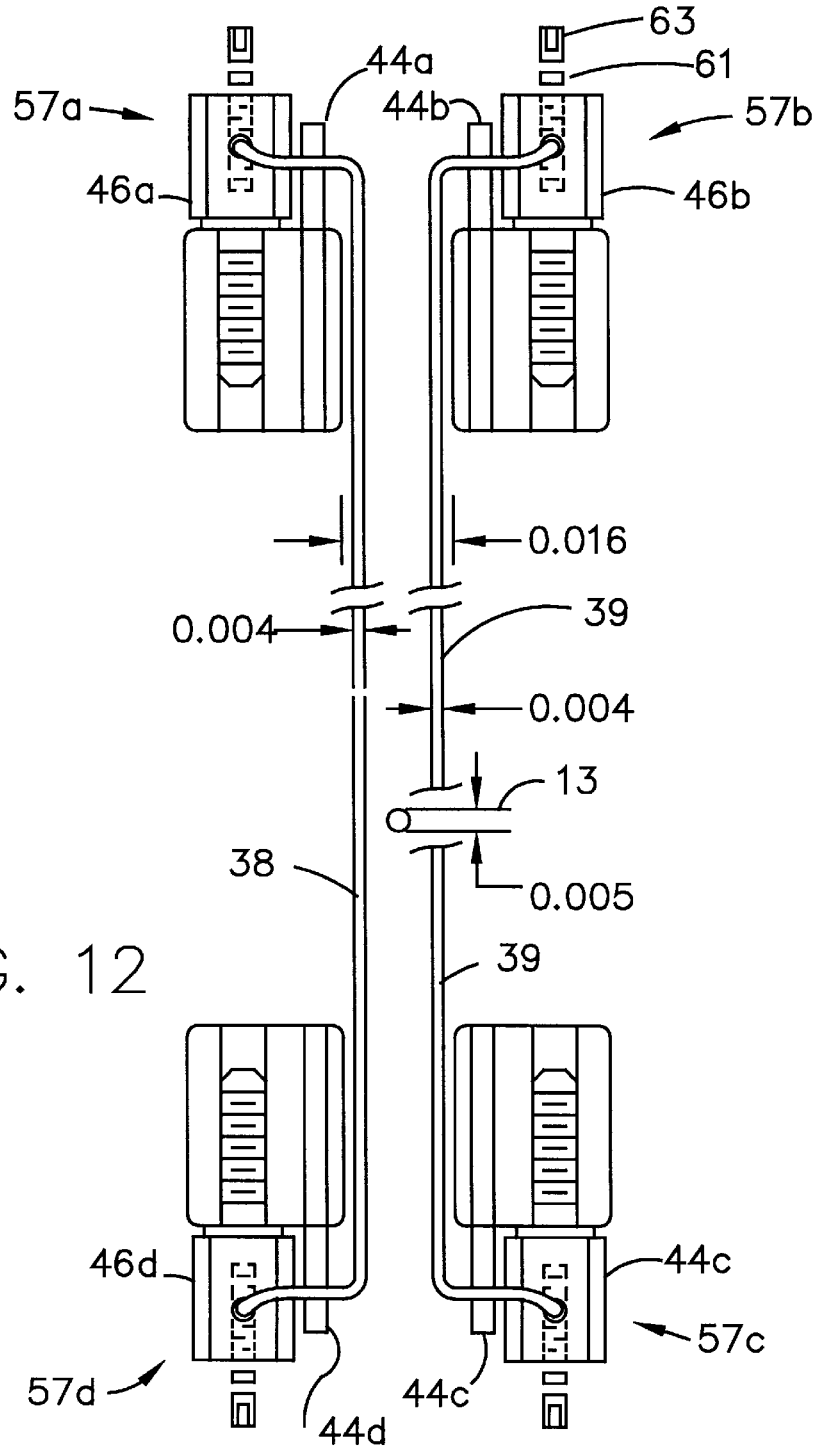
FIG. 12 is a schematic end view of the music wires with a fiber passing between them, the music wires being moored by standoffs at both top and bottom of the right and left guide arms.

FIG. 12 is a schematic end view of the wire strands, the top and bottom throats, and the fiber 13 passing between the wire strands. Standoffs 57*a*, 57*b*, 57*c* and 46*d* are shown along with dowel pins 44*a*, 44*b*, 44*c* and 44*d* at the top and bottom pay guide hands. The fiber 13 is shown passing around the dowel pins 44 and entering the receiving hole in each of the hexagonal hollow standoff bodies 46*a*, 46*b*, 46*c* and 46*d*. This figure shows the spaced apart left and right parallel strand or guide piano wires 38, 39 guiding the glass or optical fiber 13 therebetween. The diameter of the wire may be 0.004 inches and the spacing between the wires 0.008 inches. The glass fiber, in this example, has a diameter that is typically in the range of 0.0031 inches to 0.0049 inches.

Fiber Guide Wire Installation Procedure

FIG. 12 is a schematic view of the ends of the left and right pay guide arms. The steps for installing the music wire or left and right parallel strand or guides 38, 39 into the fiber guide and adjusting the tension proceeds as follows:

1. Install the hex standoffs 46 (item 1) into the tapped holes of the left and right pay guide arms. Torque until standoffs 46 make light contact with Fiber Guide body.
2. Using 0.004" diameter music wire, cut off an approximate 12 inch length.
3. Referring to FIGS. 12 and 13, thread one end of wire through a cross-drilled hole in a standoff 46.
4. Install the o-ring segment into the threaded hole of the standoff 46.
5. Install the set-screw into the same threaded hole following the o-ring segment. Torque the set-screw sufficiently such that the wire is restrained in the hole. Apply 1 to 3 full wraps of wire around standoff prior to routing around 0.125" die dowel pin 44 (see FIG. 1). Wire Installation, "Top End" (left hand view, FIG. 1):
6. Route wire around 0.125" die dowel pin 44 (see FIG. 1) followed by 1 to 3 full wraps (CCW) around standoff (item 1). Next, thread the end of the wire through the cross-drilled hole in the standoff 46 for the lower end of the pay guide hand.
7. Install o-ring segment and set-screw per steps 4 and 5.
8. Lightly tension the wire by rotating the standoff.
9. Using a dowel, gently push both wires in and out, at each end of Fiber Guide, attempting to make them parallel when viewed from the side of the Fiber Guide. From this view, only one wire should be visible.
10. Repeat steps 2 through 8 using the other length of wire.

Final Tension Adjustment

11. Using a gram force gage at the wire mid-span, check the lateral deflection force of each wire for a deflection of 0.004" at mid-span. Note that 0.004" can be estimated when wires are viewed under a microscope: 0.004"=1 wire diameter.
12. Adjust the "Top End" standoff (item 1) to obtain 3.0 to 4.0 grams deflection force for 004" lateral deflection.
12. Check wire separation gap at both ends of Fiber Guide. Verify that gaps are within 0.0075" to 0.0085". If necessary, fiber guide mating surfaces can be shimmed to achieve the correct spacing.

FIG. 13 is a more detailed exploded view of the standoff 46. Rubber plug 61 and #6-32 set screw 63 are also shown with a drill hole in the side of standoff 46. The music wire is draw through the cross drilled hole and locked in place by the rubber plug as the rubber plug is driven into the axial hole by the #6-32 screw. Once the music wire, extending through the cross drilled hole, is locked in place by the rubber plug, the tension of the music wire is adjusted by turning the standoff.

Figure 14:
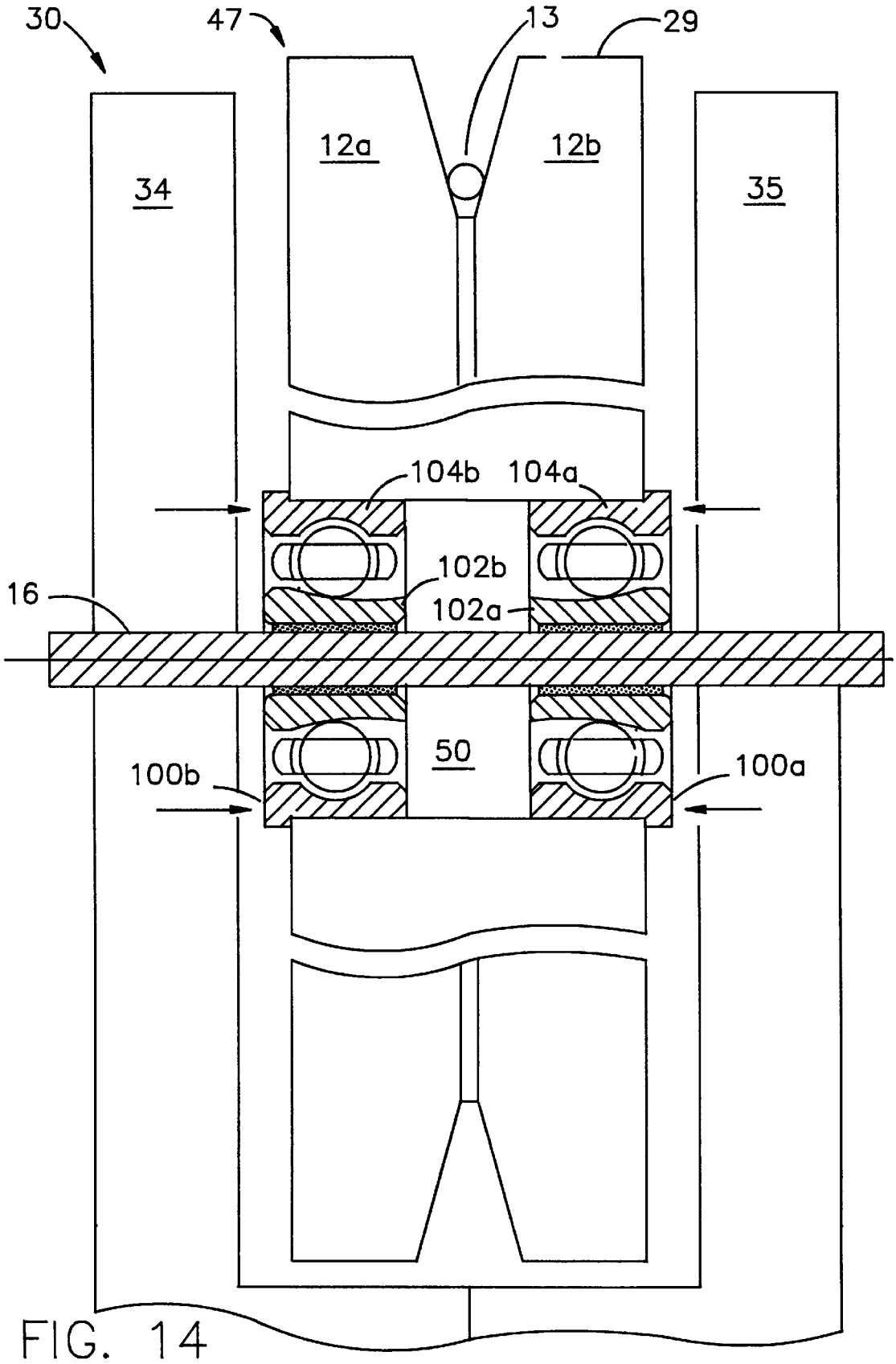
FIG. 14 is a schematic partial section of the guide wheel supported by a shaft between the left and right pay guide hands.

FIG. 14 is a partial section schematic view of the guide pulley 47 having a guide pulley wheel having a left and right face 12*a*, 12*b* and an axle hole 50. The guide wheel 12 is carried by the pay guide assembly 30 to guide the glass fiber 13 to and between the left and right parallel strands 38, 39 of music wire for deposit onto the coil 22 on spool 20. The guide pulley is mounted on guide wheel shaft 16 using a right and a left ball bearing 100*a*, 100*b*. Each respective bearing has an inner 102*a*, 102*b* race and outer race 104*a*, 104*b*. Each respective race has a respective inner and outer surface.

FIG. 15 shows a schematic sectional view of a coil form 20 mounted on a mandrel 82 prior to use for winding a coil. If the coil form 20 is of non-conductive material, the inner walls of the spool flange inner surfaces or coil form flanges 27*a*, 27*b* shown in FIGS. 6 and 15 can be used for electrically signaling when the wire strands reach the limit of lateral travel. The tool 81 shown is draped over the coil form. Lower left and right registration walls 83, 84 are co-planar with the upper inner registration walls 85, 86. The tool is typically of aluminum. Upper and lower guide pins 87, 88 allow the left and right halves to extend and contract with near perfect orthogonality.

Top and bottom springs 89, 90 restore the halves to engage and retain contact with the inner walls of the flanges. The left and right upper inner registration walls 85, 86 are conductive and co-planar with the inner walls of the flange. The inner registration walls 85, 86 are electrically contacted by the left and right parallel strands 38, 39 to signal the servo 75 and teach the servo where the limits of travel are in relation to the inner walls of the spool flange inner surfaces 27*a*, 27*b*.

Figure 16:
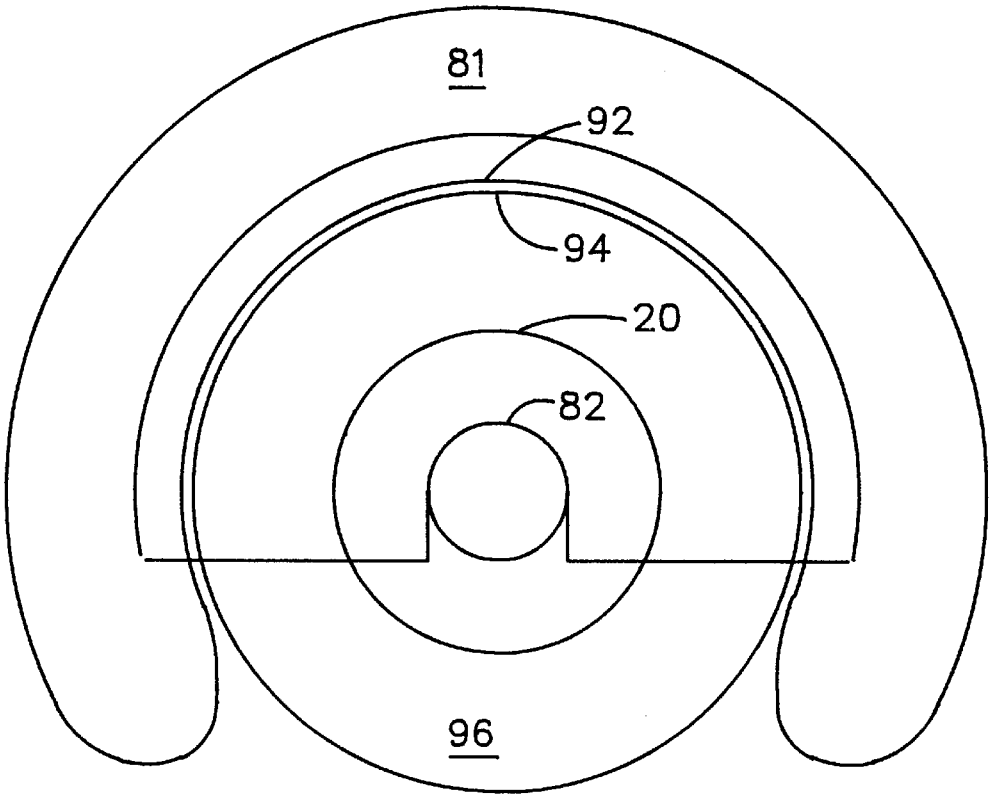
FIG. 16 is schematic end view of the tool of FIG. 16 draped over the spindle of a non-conductive spool or bobbin.

In this embodiment, lateral travel limits are detected by use of the conductive flanges on the aluminum tool of FIG. 15 and 16 that is positioned over the spool. The tool is machined to precisely register on the spool and carry the location of the flanges radially outward into the path of the music wires in their lateral travel.

In operation, the fiber guide is moved by a linear motor, laterally under encoder and servo computer control near the surface of fiber coil. At the limit of travel, one of the music wires electrically contacts the inner surface of the tool outer flange which is co-planar with the inner surface of the bobbin flange.

FIG. 16 shows the tool 81 of FIG. 16 draped on the mandrel containing a non-conductive coil form or bobbin. The inner periphery 92 of the tool's outer flange is close to the outer periphery 94 of the left bobbin chuck 96. The right bobbin chuck is 98.

While the invention has been explained in connection with a single embodiment, it is intended that only the appended claims be used to limit the scope of this patent.

What is claimed is:

1. A fiber guide for fiber comprising, in combination;

a rigid body shaped to form a receiving aperture; two parallel wire strands spaced apart across the receiving aperture of the body; and a guide pulley carried by the body for guiding the fiber between the wire strands and onto a spool.

2. The fiber guide of claim 1 wherein the body comprises two payguide hands coupled together in opposing relation, with a throat gap between the payguide hands at ends of the payguide hands.

3. The fiber guide of claim 2 wherein the wire strands are music wires; and the payguide hands have a recess for receiving the guide pulley and fiber.

4. The fiber guide of claim 2 further comprising:

at least a first and second hollow threaded standoff, each standoff having a threaded end, and wherein each payguide hand has a hole to receive the threaded end of a hollow threaded standoff, each hollow threaded standoff having a cross hole therethrough for receiving a wire strand; and, a rubber plug followed by, a set screw inserted into the hollow standoff to securely bind the wire in the cross hole.

5. The fiber guide of claim 1 wherein the parallel wire strands are, in the alternative, formed from piano or music wire.

6. The fiber guide of claim 1 wherein the the body comprises two payguide hands having a top and bottom end, a throat gap being formed between the payguide hands at the top end.

7. The fiber guide of claim 1 further comprising, means for anchoring the wire strands to the body, and wire tensioning means carried by the body to tension the wire strands.

8. The fiber guide of claim 1 wherein the body comprises two payguide hands, each having a top and bottom end with a slight gap between the the top and bottom ends of the payguide hands providing a corresponding top and bottom throat; each respective throat having a respective first and second side separated by a predetermined distance, each respective wire strand being in contact with a corresponding top and bottom side.

9. The fiber guide of claim 1 wherein the tensioning means comprise a pair of pivot plates pivotally connected to the body and to the parallel wire strands; and, a spring connected between the pair of pivot plates and the body for drawing the parallel wire strands into a tensioned condition, and a threaded screw engaging the pair of pivot plates at a moment arm distance from the pivotal connection between the pair of pivot plates and the body as to apply a torque to the pair of pivot plates as the spring is extended by operation of the threaded screw.

10. A fiber guide for spooling fiber from an automatic coil winding machine onto a spool comprising in combination:

a rigid body having a generally arcuate opening and comprising two similar sections held together with a gap between the sections;

two parallel strands of wire tightly stretched across the arcuate opening of the arc and anchored;

a spool for receiving the fiber from between the wire strands;

a guide pulley rotatably mounted on a guide pulley shaft, the guide pulley shaft being carried by the body, the guide pulley rotating on the shaft to guide the fiber from the winding machine onto the spool via the space between said wire strands;

guide pulley bearing means on the shaft for rotatably supporting the guide pulley;

adhesive means for fixing the bearing means in a predetermined position to locate the pulley guide to direct the fiber between the strands; and, means for connecting the winding machine and said body.

11. The fiber guide of claim 10 wherein;

the bearing means further comprises:

a left bearing, and a right bearing, the left and right bearing each having an inner and outer race;

the guide pulley being positioned between the left and right bearing on the guide pulley shaft, and wherein the inner race of the left and right bearing is coupled to the guide pulley shaft with glue, the predetermined position of the bearing means being a manually adjusted position to preload the bearing means to be substantially free of wobble, the preload being adjusted to a level at which a first slight deceleration is observed subsequent to and in response to manually spinning the guide pulley.

12. A fiber guide and automatic coil winding machine combination for spooling glass fiber onto a spool comprising:

a fiber guide comprising;

a rigid body having an arcuate opening and comprising two similar sections held together with a gap between the sections;

two parallel strands of wire tightly stretched across the arcuate opening of the arc and anchored;

a spool for receiving the glass fiber mounted so it extends into the arc between the wire strands;

a guide pulley carried by the body for guiding the glass fiber from the winding machine onto said spool via the space between said wire strands; and, an automatic coil winding machine, a pivotally mounted connection between the automatic coil winding machine and said body.

13. The fiber guide and automatic coil winding machine combination in of claim 12 wherein the spool has a spool rotation axis and a predetermined window for receiving fiber, the predetermined window being bordered by a spindle, the spindle having a surface and a left and right flange inner surface of predetermined height above the spindle surface, and wherein the coil winding machine further comprises:

servo means for moving the fiber guide parallel to the spool rotation axis as the spool is rotated.

14. The fiber guide and automatic coil winding machine combination of claim 13 wherein the wire strands are electrically insulated from the automatic coil winding machine; and, means for electrically sensing and teaching the servo means the limits of travel parallel to the rotation axis of said spool rotation axis to brings each respective strand to a corresponding left and right flange inner surface.

* * * * *